US010060210B2

(12) United States Patent
Braekke

(10) Patent No.: US 10,060,210 B2
(45) Date of Patent: Aug. 28, 2018

(54) FLOW CONTROL DOWNHOLE TOOL

(71) Applicant: Dreco Energy Services ULC, Edmonton (CA)

(72) Inventor: Kristoffer Braekke, Stavanger (NO)

(73) Assignee: DRECO ENERGY SERVICES ULC, Calgary (CA)

( * ) Notice: Subject to any disclaimer, the term of this patent is extended or adjusted under 35 U.S.C. 154(b) by 444 days.

(21) Appl. No.: 14/724,051

(22) Filed: May 28, 2015

(65) Prior Publication Data

US 2015/0345253 A1 Dec. 3, 2015

(30) Foreign Application Priority Data

Jun. 3, 2014 (NO) ..... 20140691

(51) Int. Cl.
*E21B 34/14* (2006.01)
*E21B 21/10* (2006.01)

(52) U.S. Cl.
CPC ..... *E21B 21/103* (2013.01)

(58) Field of Classification Search
CPC ... E21B 21/103; E21B 34/14; E21B 2034/007
See application file for complete search history.

(56) References Cited

U.S. PATENT DOCUMENTS 3,025,919 A * 3/1962 Angel ..... E21B 21/103 166/321
4,298,077 A * 11/1981 Emery ..... E21B 4/02 175/107
4,298,078 A * 11/1981 Lawrence ..... E21B 17/07 166/333.1
4,749,044 A 6/1988 Skipper et al.
6,109,354 A 8/2000 Ringgenberg et al.
6,378,612 B1 * 4/2002 Churchill ..... E21B 21/103 166/319
6,491,098 B1 * 12/2002 Dallas ..... E21B 43/116
9,677,376 B2 * 6/2017 Swietlik ..... E21B 34/06
9,708,872 B2 * 7/2017 O'Neal ..... E21B 21/103
(Continued)

FOREIGN PATENT DOCUMENTS

WO 03/004828 1/2003
WO 2013/034577 3/2013

OTHER PUBLICATIONS

Norwegian Search Report dated Dec. 18, 2014 in corresponding Norwegian Application No. 20140691.

*Primary Examiner* — James G Sayre
(74) *Attorney, Agent, or Firm* — Conley Rose, P.C.

(57) ABSTRACT

A downhole tool includes a housing and a mandrel glidingly arranged within the housing, wherein the mandrel is formed as a piston. The flange is acting on a spring arranged around the mandrel. In a first position of the mandrel, a fluid flow can run 100% through the tool via a first nozzle at a first end of the housing, the inside of the mandrel and a second nozzle at a second end of the housing. At a predetermined flow rate and with the help of a passage arranged in the housing wall and connecting the first side of the tool with the space or ring room on the non-spring side of the mandrel and a side port in the mandrel on its spring side, the mandrel will be moved towards the second nozzle due to sufficient force acting on a flange of the mandrel thus overcoming the spring resistance.

6 Claims, 3 Drawing Sheets

(56) References Cited

U.S. PATENT DOCUMENTS

| | | | | |
|---|---|---|---|---|
| 2006/0225885 | A1* | 10/2006 | Mcgarian | E21B 21/103 166/334.4 |
| 2010/0044054 | A1* | 2/2010 | de Boer | E21B 21/10 166/373 |
| 2010/0276927 | A1* | 11/2010 | Simonian | E21B 17/042 285/383 |
| 2011/0042100 | A1* | 2/2011 | O'Neal | E21B 21/103 166/373 |
| 2011/0168410 | A1* | 7/2011 | deBoer | E21B 21/10 166/386 |
| 2011/0278017 | A1* | 11/2011 | Themig | E21B 34/14 166/373 |
| 2013/0043045 | A1* | 2/2013 | George | E21B 21/001 166/373 |

* cited by examiner

FLOW CONTROL DOWNHOLE TOOL

The present invention generally relates to a flow control tool for use in a wellbore, and particularly a flow control valve adapted for use in a well, alone or with other downhole tools.

The process of making a production well, after drilling it, ready for production and/or injection is called completion of a well. This principally involves: preparing the bottom of the borehole at, or in the proximity of, the production layer(s) to meet the required specifications; running in the production tubing or pipe and its associated downhole tools; as well as perforating and stimulating, as required. The process of running in and cementing the casing can also be included, if necessary due to the strata structure. All these processes will be described in detail below.

A subterranean formation containing hydrocarbons comprises at least one layer of soft or fractured rock(s) or strata containing the hydrocarbons, in the following called a production layer. Each production layer must be covered by a layer of impermeable rock(s) or strata preventing the hydrocarbons from escaping therefrom. The production layer(s) in an oil or gas field are collectively called and/or known as a reservoir.

The drilling can be done vertically through one or more strata/rock layers in order to reach the desired production layer(s), and then possibly horizontally along one or more strata to provide as efficient well(s) as possible. A production well extending through the reservoir is conventionally divided into several production zones, and particularly one or more production zones per one production layer. A production well may extend several thousand meters vertically through the formation, and be connected to substantially horizontal branches extending up to several kilometers through the production layer(s).

The drilling in the geological strata can be done by rotating a drill bit at the end of a drill string and forcing it in the desired direction through geological or rock layers or strata to create or form a wellbore. Once a predetermined length of the wellbore is drilled, the drill string with the drill bit may be pulled out, and the wellbore may be lined with a steel pipe called a casing or liner. Hence, an outer annular space or ring room is formed between the casing and the formation. It is a common, but not obligatory, practice to cement the casing to the formation by filling all or part of the outer annular space with cementing slurry or slurries. Open boreholes or wellbores are also common, when the strata allow having such. A fully or partially cemented casing can stabilize the formation and at the same time can make it possible to isolate certain layers or regions behind the casing for retrieval of hydrocarbons, gas, water or even geothermal heat. It is well-known to anyone skilled in the art that e.g. epoxy/resin-based cementing slurries in some cases are better suited for the task than cement based mixtures.

The terms "cement" and "cementing" are thus to be construed generally as use and/or injection of a viscous slurry, which then hardens for the purpose of retaining the casing in the formation and/or stabilizing the formation and/or creating a barrier between different zones, and not exclusively as use of cement only. Cementing tools or valves may be arranged in the casing at predetermined locations. When a segment of the casing is to be cemented, the cementing valve is opened and cement slurry is pumped down the casing, out through the valve ports, and into the outer annular space between the casing and the formation. The person skilled in the art will be familiar with the use of suitable plugs, staged cementing, in which a first batch of cement or liquid slurry is allowed to set before the next batch of cement or liquid slurry is pumped into the outer annular space above it, thus reducing the hydrostatic pressure from the cement, which might otherwise harm or damage a weak formation, and other cementing techniques and details.

During cementing, injection and production in wells as those described above, the possibility for large differential pressures between different zones increases with increasing depth(s). Production of hydrocarbons from strata deep below the seabed and geothermal applications are both likely to involve large or high pressures. Isolation of zones and injection of liquid or gas to increase the pressure in the production zones or regions can lead to correspondingly large differential pressures.

When a well is drilled and lined with a casing, a return flow path from the formation around the casing to the surface must be established. In some instances, it is possible to penetrate the casing by setting off explosive charges at one or more predetermined depths to enable radial flow of production fluid from the formation into the casing. In other instances, the casing may be provided with prefabricated holes or slits, possibly combined with sand screens. In many applications, the combination of high hydraulic pressure and relatively porous production strata implies a substantial risk for damage of the formation if explosives are used to penetrate the casing. In these cases, it is a common practice to use valve sections with radially extending openings which are opened to allow radial flow of cement or epoxy/resin out of the casing for stabilizing and retaining the casing in the formation, and/or for radial flow of injection fluid from inside the pipe to the surrounding formation to maintain or increase the hydraulic pressure in the formation, and/or for radial flow of production fluid from the formation into the casing. Such valve sections designed for inclusion in a tubular, usually by means of threaded couplings of the same kind as used when connecting the pipe segments to a string, are called "valves" in the following for simplicity.

Hydraulic fracturing, poses particularly demanding requirements to the design, robustness and durability of the valve(s). In hydraulic fracturing, a mixture containing e.g. 4% small ceramic particles can be injected into the formation at a pressure quite above the formation pressure. Fractures in the formation are expanded by the pressure and filled with these particles. When the hydraulic pressure is removed, the particles remain in the fractures and keep them open. The purpose is to improve the inflow of production fluid from the formation and into a so-called production pipe.

It is also a common practice to insert at least one production pipe into the casing. The inner annular space or ring room between the casing and the production pipe is filled with a suitable liquid/fluid or mud, and is generally used to maintain and increase hydraulic pressure. The production pipe is in these cases used as the return path, and conveys the production fluid up to the surface. When using a production pipe within the casing, it is of course also necessary to provide the production pipe with openings or apertures for inflow of production fluid therein, and it may be necessary to isolate production zones from the liquid/fluid or mud in the inner annular space between the production pipe(s) and the casing. Isolating the different zones can be accomplished by using mechanical plugs called "packers", rather than by using cementing slurry or slurries. Such packers are mainly used in the inner annular space between the production pipe and the casing, because it may be problematic to achieve sufficient sealing against the formation, especially if the formation is porous. Valves corresponding to the valves described above can be arranged in the production pipe(s), and they can be opened once they are localized in the production zone(s).

One or more injection wells may be provided at a distance from the production well(s) in a field. The injection well(s) can be used to pump water, saline and/or gas back into the formation in order to increase the pressure. Additives such as acid, solvents or surfactants may be added to the fluid in order to enhance the production of hydrocarbons in processes known as "stimulating a zone".

Valves can be used to control the flow of formation fluid from a production zone into the production pipe through the casing, possibly through a horizontal and/or vertical branch. Valves can also be used for controlling an injection fluid from an injection well into a certain zone of the formation to be stimulated. When the formation fluid from a production zone contains too much water to be economically sustainable, the production zone can be shut down, typically by means of one or more valves. The valves are operated between open and closed, and possibly choked, positions using a variety of techniques, including use of wireline tools, strings of pipes, coiled tubing, self-propagating tools known as borehole or well tractors or runners, and drop balls or the like. Some valves may be operated using separate hydraulic control lines. However, the space and cost required for providing separate hydraulic control lines and relatively expensive hydraulic valves quickly make hydraulically operated valves impractical for use in a tubular having many valves.

Managed Pressure Drilling (MPD) and Dual Gradient Drilling (DGD) are oil-field drilling techniques that are becoming more common and thus create a need for equipment and technology in order to make them practical. These drilling techniques often utilize a higher density of drilling mud inside the drill string and a lower density return mud path on the outside of the drill string. In dual gradient drilling (DGD), an undesirable condition called "u-tubing" can result when the mud pumps for a drilling system are stopped. Mud pumps are commonly used to deliver drilling mud into the drill string and to extract return mud from the wellbore and return riser(s). In a typical u-tubing scenario, fluid flow inside a drill string may continue to flow, even after the mud pumps have been powered down, until the pressure inside the drill string is balanced with the pressure outside the drill string, e.g. in the well bore and/or the return riser(s). This problem is exacerbated in those situations, where a heavier density fluid precedes a lighter density fluid in a drill string. In such a scenario, the heavier density fluid can cause, by its own weight, a continued flow in the drill string even after the mud pumps have been shut off. This u-tubing phenomenon can result in undesirable well kicks, which can cause damage to a drilling system. For this reason, it is desirable that when mud pumps in a drilling system are turned off, the forward fluid flow is discontinued quickly. The present invention can be utilized in drilling operations.

In a functioning production well, one of the maintenance operations that is performed is a hole-cleaning. There are several methods for cleaning a wellbore, and in particular for cleaning the inside of a casing or an annulus of e.g. an oil well, using hole-cleaning or washing tools, wherein the wireline or downhole cleaning tool is lowered into the well or casing in the proximity of the area where deposits or debris are to be removed from the inside of the well or casing. A washing or flushing fluid is pumped through the work string and out into the casing or well via the washing or cleaning tool. After the cleaning operation is completed the cleaning tool may be withdrawn from the well or casing. The cleaning tool can comprise an inlet for jetting flushing fluid into the tool from the work string, and a rotatable nozzle head or bit having a plurality of nozzles and being in fluid communication with the inlet. The capacity in liters per minute (l/min.) of the cleaning tool is limited to e.g. about 250-350 l/min. However, it is sometimes desired and/or necessary to pump into the well more liters per minute (l/min.), e.g. about 500-700 l/min. This problem can be solved by use of the present invention.

Furthermore, when necessary or needed to operate (e.g. close and/or open) a valve such as e.g. a sleeve valve, a shifting tool can be used. Before operating said valve with the shifting tool, a jetting tool is usually used to clean the valve, particularly its engagement portions/profiles or recesses. The present invention can simplify these operations, and be used as a jetting tool together with the shifting tool.

The main features of the present invention are given in the independent claims. Additional features of this invention are given in the dependent claims.

The invention relates to a downhole tool comprising a housing and a mandrel. The housing can be annular and/or tubular. The mandrel is axially hollow. The mandrel is glidingly arranged within the housing. The mandrel is arranged between an inflow portion or element arranged within the housing at one or first end and a discharge portion or element arranged within the housing at the other or second end. The mandrel can be formed as a piston comprising an outer flange. The outer flange is dividing the mandrel or piston in two parts, an inflow part and an outflow part, respectively. The outer flange is arranged in the space or ring room between the mandrel or piston (particularly its outer surface) and the inner surrounding wall or surface of the housing. The outer flange can have a sealing ring for sealing the space or ring room between the outer surface of the inflow part of the mandrel or piston and the inner surrounding wall or surface of the housing from the space or ring room between the outer surface of the outflow part of the mandrel or piston and the inner surrounding wall or surface of the housing. The flange can be acting on a first end of a spring being arranged around the mandrel or piston. The spring can be arranged particularly in the space or ring room between the outer surface of the outflow part of the mandrel or piston and the inner surrounding wall or surface of the housing. The other or second end of the spring can be leaning against a ring room sealing element. The ring room sealing element can be arranged at, or in the proximity of, the discharge portion or element that is arranged within the housing and at its other or second end thereof. The mandrel can have several positions in the housing. In an initial or first position of the mandrel or piston, a fluid flow can run 100% through the tool via an inflow nozzle of the inflow portion or element, through the inside of the mandrel or piston and out of a discharge nozzle of the discharge portion or element. On the non-spring or inflow side or part of the mandrel, the housing can be arranged with at least one flow side port and/or nozzle. The mandrel itself (particularly its non-spring or inflow side or part) can be arranged or supplied with at least one side port. At a predetermined flow rate having a first predetermined pressure and with the help of a passage arranged in the housing wall and connecting the inflow side of the tool with the space or ring room on the non-spring or inflow side of the mandrel or piston and at least one side port in the mandrel or piston and being arranged on its spring or outflow side, the mandrel can thus be moved towards the discharge nozzle of the discharge portion or element, due to (predetermined or controlled) pressure drop or loss over the inflow nozzle, thus providing for sufficient force on the mandrel or piston overcoming the spring resistance, so that, in this second position of the mandrel or piston, the fluid flow will be split in two paths: 1) one side flow (or side flow path) through the side port(s) in the mandrel and the flow side port(s) or nozzle(s) in the housing, both being concurrent with each other in this instance, and 2) one through-flow (or through-flow path) through the tool center (that is the inside of the mandrel or piston) and via or out of the discharge nozzle of the discharge portion or element.

As mentioned above, the side flow through the side ports can be used as a flushing or jetting flow in e.g. hole-cleaning or valve-operating operations, while the through-flow can be used to further operate other downhole tools. Furthermore, the two flows (i.e. the side and through flows) can be regulated in a controllable manner with respect to what is desired to be achieved or to the respective or intended downhole operation. For example, in a cleaning operation, the side flow running into the casing can mainly be regulated to be approximately equal as the through-flow supplied to the cleaning tool, e.g. around 300 l/min, thus allowing about 600 l/min. to be pumped through the work string. While, for example, in a valve-operating operation, the side flow for jetting the engagement profile or recess of the valve can be regulated to be about 200 l/min., and the through-flow supplied to the shifting tool can then be regulated to be about 150 l/min.

Furthermore, the discharge nozzle of the discharge portion or element can be arranged to be plugged, so that the entire fluid flow of the tool will run 100% sideways in a third instance (i.e. a third status of said tool).

The flow control tool can be a flow controlled valve/flow control valve.

The invention will be described in greater detail in the following with reference to the accompanying drawings in which similar numerals refer to similar parts, and where:

Figure 1:
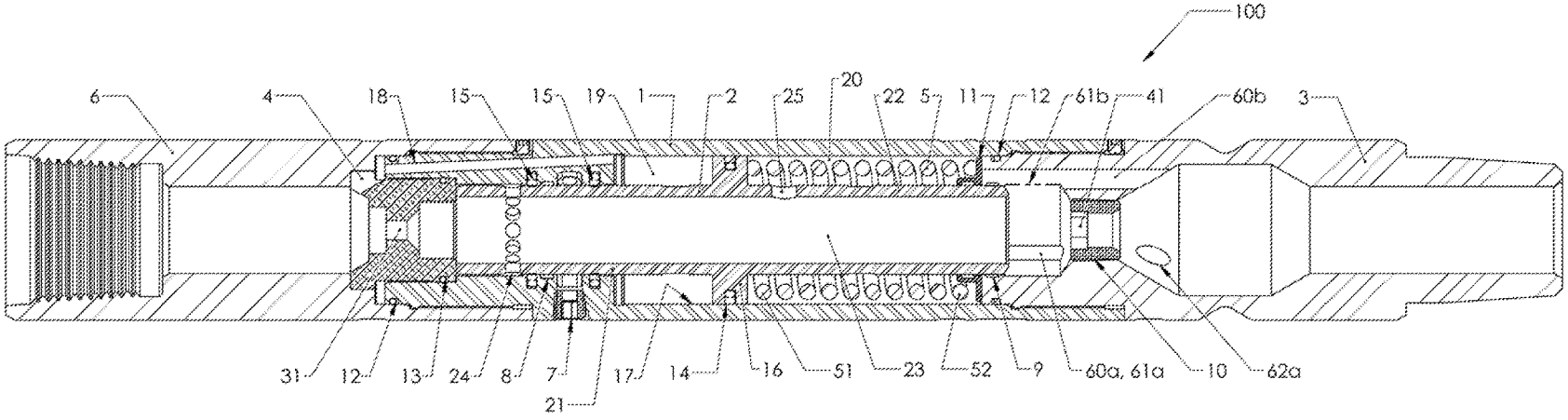
FIG. 1 shows an embodiment of the flow control tool in its initial or first status or the first position of the mandrel/piston, allowing only through-flow.

FIG. 1 illustrates one embodiment of the invention, namely a downhole tool 100 and particularly a flow control tool 100. The flow control tool 100 comprises a housing 1 and a mandrel 2, which on FIG. 1 is in a first position, i.e. the tool 100 is in a first status. The housing 1 is annular and/or tubular. The housing 1 has a top or upper end (the end to the left in the figures) and a bottom or lower end (the end to the right in the figures). The mandrel 2 is axially hollow. The mandrel 2 can be annular and/or tubular. The mandrel 2 is glidingly or moveably arranged within the housing 1 and is thus allowed to be axially moved therein and have several positions in relation to the housing 1. The mandrel 2 is arranged between an inflow or top portion or element 4 arranged within the housing 1 at said top or first end and a discharge portion or element 10 arranged within the housing at the inflow or second end. The mandrel 2 is formed as a piston 2 comprising an outer flange 16. The outer flange 16 is dividing the mandrel or piston 2 in two parts 21, 22: an inflow or top part 21 and an outflow or bottom part 22, respectively. The outer flange 16 is arranged in the space or ring room 19, 20 between the mandrel or piston 2 (particularly its outer surface) and the inner surrounding wall or surface 17 of the housing 1. The outer flange 16 can have a sealing ring 14 for sealing the space or ring room 19 between the outer surface of the inflow or top part 21 of the mandrel or piston 2 and the inner surrounding wall or surface 17 of the housing 1 from the space or ring room 20 between the outer surface of the outflow or bottom part 22 of the mandrel or piston 2 and the inner surrounding wall or surface 17 of the housing 1. The flange 16 is acting on a first end 51 of a spring 5 that is arranged around the mandrel or piston 2. The spring 5 can be arranged particularly in the space or ring room 20 between the outer surface of the outflow or bottom part 22 of the mandrel or piston 2 and the inner surrounding wall or surface 17 of the housing 1. The other or second end 52 of the spring 5 can be leaning against a ring room sealing element 11. The ring room sealing element 11 is arranged at, or in the proximity of, the discharge portion or element 10 that is arranged within the housing 1 and at its bottom or second end thereof. As previously mentioned, the mandrel 2 can have several positions in the housing 1. In an initial or first position of the mandrel or piston 2, shown on FIG. 1, a fluid flow can run 100% through the tool 100 via an inflow or top nozzle 31 of the inflow or top portion or element 4, through the inside 23 of the mandrel or piston 2 and out of a discharge or bottom nozzle 41 of the discharge portion or element 10.

Figure 2:
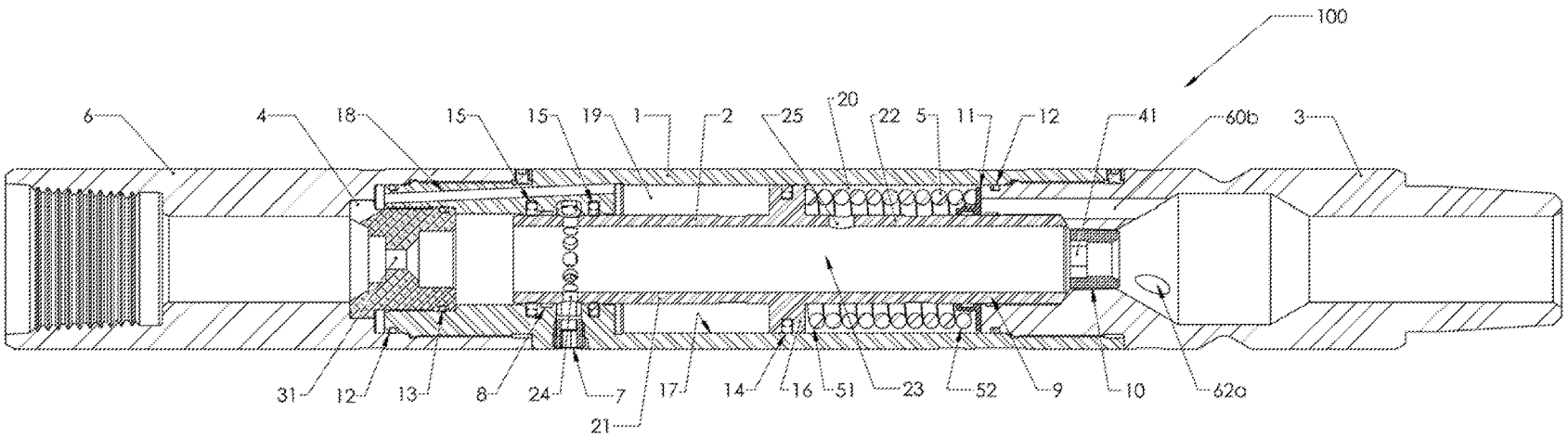
FIG. 2 shows an embodiment of the flow control tool in its second status or the second position of the mandrel/piston, allowing side flow and through-flow.

FIG. 2 illustrates said embodiment of the tool 100 according to the present invention, where the mandrel or piston 2 is being moved to a second position, i.e. the tool 100 is in a second status. On the non-spring or inflow side or part 21 of the mandrel 2, the housing 1 can be arranged with at least one (radial) flow side port 7 and/or nozzle 7. The mandrel 2 itself (particularly its non-spring or inflow side or part 21) can be arranged or supplied with at least one side port 24. When increasing the flow rate, at a predetermined flow rate having a first predetermined pressure and with the help of: i) a passage 18 arranged in the housing 1 wall and connecting the inflow or top side of the tool 100 with the space or ring room 19 on the non-spring or inflow side 21 of the mandrel or piston 2, and ii) at least one (radial) side port 25 in the mandrel or piston 2 and being arranged on its spring or outflow side 22, the mandrel 2 can thus be moved towards the discharge or bottom nozzle 41 of the discharge or bottom portion or element 10, due to (predetermined or controlled) pressure drop over the inflow or top nozzle 31, thus providing for sufficient force on the mandrel or piston 2 (and particularly on the flange) overcoming the spring 5 resistance, so that, in this second position of the mandrel or piston 2, shown on FIG. 2, the fluid flow, starting from the inflow or top nozzle 31, will be split into two (flow) paths: 1) one side flow (or side flow path) through the side port(s) 24 in the mandrel 2 and the flow side port(s) 7 or nozzle(s) 7 through the housing 1 wall, both ports and/or nozzles 24, 7 being concurrent with each other in this instance, and 2) one through-flow (or through-flow path) through the tool center (i.e. the inside 23 of the mandrel or piston 2) and via or out of the discharge or bottom nozzle 41 of the discharge portion or element 10.

The first or top or inflow portion or element 4 can be a first nozzle adapter 4. The second or bottom or discharge portion or element 10 can be a second nozzle adapter 10. Both nozzle adapters 4, 10 can be different or the same depending on the nozzles 31, 41 used.

Figure 3:
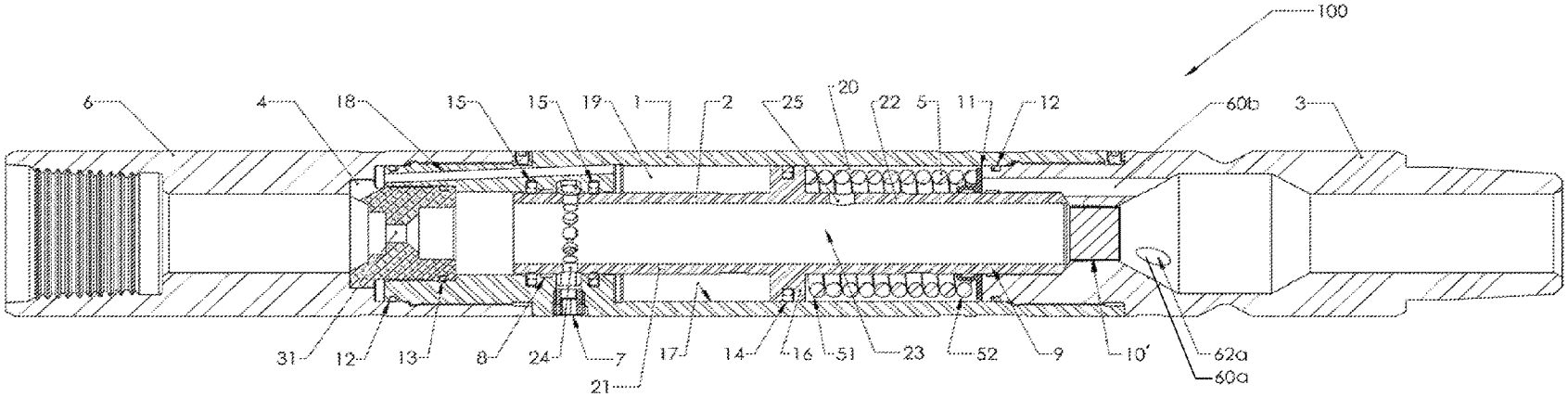
FIG. 3 shows an embodiment of the flow control tool in its third status, having the mandrel/piston in its second position, allowing only side flow.

The discharge or bottom nozzle 41 of the bottom or discharge portion or element 10 can be adapted and/or arranged to be plugged, so that the entire fluid flow of the tool 100 will run 100% sideways, through ports and/or nozzles 24, 7, in a third instance (i.e. a third status of said tool 100). FIG. 3 shows an example of the third status of tool 100. In FIG. 3, tool 100 includes a bottom or discharge portion or element 10' in place of element 10. Element 10' is plugged and does not provide a flow path between mandrel 2 and bottom end 3. Like FIG. 2, in FIG. 3, mandrel 2 is in position 2 with respect to housing 1. As a result, in FIG. 3 mandrel 2 is positioned towards element 10', blocking the bypass duct or canal 60*a*, 60*b* and aligning ports 24 of mandrel 2 with ports 7 of housing 1 configuring the tool so that the entire fluid flow of the tool will run sideways, radially. Through-flow from mandrel 2 to the bottom connector or sub 3 is blocked. Alternatively, a bypass canal or duct 60*a* can be arranged in the tubular bottom connector or sub 3, having one kind of opening 61*a* (see alternative possible opening 61*b* of canal 60*b*) as shown in FIG. 1 (position 1) being between the mandrel's 2 bottom end and the plugged bottom or discharge portion or element 10 and another opening 62*a* arranged after the plugged portion 10, 41 (in the direction coming from the mandrel 2 and towards the bottom end 3 of the tool 100). In position 1, shown in FIG. 1, the fluid flow will then go through the tool 100 and its mandrel 2 and through the bypass canal or duct 60*a*, bypassing thus the already plugged portion 10, 41. As an example, this arrangement for bypass flow could be achieved with the tool 100 as configured in FIG. 3, having a plugged element 10'. Mandrel 2 would be placed in position 1. Tool 100 of FIG. 3 would then allow the fluid flow in the tool to go through a bypass canal 60*a*, 60*b* to bottom end 3, and tool 100 would block sideways flow because ports 7, 24 would not be aligned. In position 2, shown in FIG. 2, the mandrel 2 has been moved downwards thus closing the first opening and passageway 61*a* of the bypass canal or duct 60*a*, and then the fluid flow will go or run out sideways via the side ports and/or nozzles 24, 7. Furthermore, the tool 100 can comprise at least one additional bypass canal or duct 60*b* (with its respective at least one opening 61*b*), e.g. but not limited to totally three canals 60*a*, 60*b* (the third canal is not shown). The opening 61*a* of the canal 60*a* can e.g. be extended or (out) stretched. Alternatively and/or additionally, said at least one opening 61*b* of the canal 60*b* can be round or hole-/port-shaped.

Said coil tubing tool or downhole tool 100 can be a flow control valve/flow controlled valve 100.

Furthermore, the housing 1 of the tool 100 can be connected to a tubular top connector or sub 6 at its first or top end, and/or to a tubular bottom connector or sub 3 at its second or bottom end.

The ring room sealing element 11 can be, but is not limited only to, a seal plate or a seal ring or a seal flange. The ring room sealing element 11 can be leaning on and/or arranged adjacent to the tubular bottom connector or sub 3. Furthermore, the bottom or discharge portion or element 10 can be arranged within the tubular bottom connector or sub 3 connected to the housing 1.

The tool 100 can further comprise various and/or necessary sealing and/or wear elements, such as, but not limited only to, wear bands 8, 9; sealing rings, O-rings 12, 13 and/or other types of rings 14, 15; wherein all these elements are shown on FIG. 1.

The relation or proportion between the side flow and the through-flow can be determined/chosen and/or varied by changing and/or depending on the side port(s)/nozzle(s) 7 and/or the (second or bottom) nozzle 41. The (first or top) nozzle 31 can also have same role, as just mentioned, together with any one of or both of said port(s) and/or nozzle(s) 41, 7.

Additional modifications, alterations and adaptations of the present invention will suggest themselves to those skilled in the art without departing from the scope of the invention as expressed and stated in the following patent claims.

The invention claimed is:

1. Downhole tool comprising a housing and a mandrel glidingly arranged within the housing between a first end and a second end of the housing, wherein the mandrel is formed as a piston comprising an outer flange separating a spring side of the mandrel from a non-spring side of the mandrel and affecting and/or acting on a first end of a spring that is arranged around the spring side of the mandrel, wherein the second end of the spring is sealingly fixed in the proximity of the second end of the housing, wherein, when the mandrel is in a first position, a ring room surrounds the non-spring side of the mandrel and a fluid flow runs through the tool via a first nozzle arranged within the housing and fixed to the housing in the proximity of the first end of the housing, the mandrel's inside, and a second nozzle arranged within the housing and in the proximity of the second end of the housing, wherein the housing is arranged with at least one flow side port or nozzle located between the first end of the housing and the flange, wherein at a predetermined flow rate and with the help of a passage that extends within the housing wall from the first end of the housing to the ring room on the non-spring side of the mandrel and also with the help of a side port through the spring side of the mandrel, the mandrel overcomes the spring resistance and is being moved towards the second nozzle in a second position, so that the fluid flow is being split in two: i) one side flow through at least one side port in the non-spring side of the mandrel that, in this second position, is aligned with said at least one flow side port or nozzle in the housing, and ii) one through-flow through the inside of the mandrel and via the second nozzle.

2. Downhole tool according to claim 1, wherein in the second position of the mandrel the relation or proportion between the side flow and the through-flow can be determined and/or varied by changing and/or regulating at least one of: said at least one flow side port or nozzle in the housing, the first nozzle and the second nozzle.

3. Downhole tool according to claim 1, wherein the second nozzle is arranged and/or adapted to be plugged, so that the entire fluid flow of the tool is to run sideways in a third status of the tool.

4. Downhole tool according to claim 1, wherein the tool is a flow controlled valve.

5. Downhole tool according to claim 1, wherein at the first end of the housing, the first nozzle is arranged within a first nozzle adapter, and at the second end of the housing the second nozzle is arranged within a second nozzle adapter.

6. Downhole tool according to claim 1, wherein the tool further comprises a first tubular connector or sub arranged to be connected to the housing at its first end, and/or a second tubular connector or sub arranged to be connected to the housing at its second end.

* * * * *